US006271652B1

(12) United States Patent
Burstein et al.

(10) Patent No.: US 6,271,652 B1
(45) Date of Patent: Aug. 7, 2001

(54) VOLTAGE REGULATOR WITH GAIN BOOSTING

(75) Inventors: Amit Burstein, Tewksbury; Daniel Shkap, Cambridge, both of MA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/670,591

(22) Filed: Sep. 29, 2000

(51) Int. Cl.[7] ..... G05F 3/16
(52) U.S. Cl. ..... 323/313
(58) Field of Search ..... 323/311, 312, 323/313, 314, 273, 282, 281

(56) References Cited

U.S. PATENT DOCUMENTS

| | | | | |
|---|---|---|---|---|
| 4,896,094 | | 1/1990 | Greaves et al. . | |
| 5,227,714 | * | 7/1993 | Lou | 323/282 |
| 5,367,249 | * | 11/1994 | Honnigford | 323/313 |
| 5,512,817 | | 4/1996 | Nagaraj . | |
| 5,559,425 | * | 9/1996 | Allman | 323/315 |
| 5,619,163 | | 4/1997 | Koo . | |
| 5,686,821 | * | 11/1997 | Brokaw | 323/273 |
| 5,739,681 | * | 4/1998 | Allman | 323/314 |

* cited by examiner

*Primary Examiner*—Adolf Deneke Berhane
(74) *Attorney, Agent, or Firm*—Connolly Bove Lodge & Hutz

(57) ABSTRACT

The invention relates to a voltage regulator providing high immunity to DC variations of a power supply. The voltage regulator comprises a voltage regulator circuit, a gain stage that is connected to the output of the voltage regulator circuit, and a voltage modulation device forming a signal feedback loop between an output and an input of the gain stage. An initial reference voltage is generated by the voltage regulator circuit and provided to an input of the gain stage. The difference between this initial reference voltage and a fractional portion of the feedback signal, from the voltage modulation device, is amplified by the gain stage. The amplified signal of the gain stage is used to modulate the reference voltage provided to an external load. Better DC accuracy and stability is obtained by using a two stage amplifier to increase the loop gain of the voltage regulator.

10 Claims, 3 Drawing Sheets

VOLTAGE REGULATOR WITH GAIN BOOSTING

FIELD OF THE INVENTION

The present invention is directed to voltage regulatory circuits. Specifically, a gain boosting circuit is disclosed to improve the voltage supply rejection, current drive range, and feedback loop stability characteristics of a voltage regulator circuit employing a bandgap reference.

BACKGROUND OF THE INVENTION

A direct current (DC), voltage regulator regulates the supply voltage to a preferred, accurate, and stable amplitude while supplying a large current to drive an external circuit load. The regulated voltage should be highly stable and accurate even when the supply voltage drifts and the circuit load change drastically.

Voltage regulation is essential in many applications. For example, a wireless, radio frequency (RF) telephone is typically operated with a battery capable of generating a raw voltage between 2.7 to 5.5 volts, depending upon its state of discharge. This battery supplies power to both the antenna load, when transmitting, and to circuits such as a voltage controlled oscillator (VCO). Because the battery voltage changes as the battery discharges and the transmission load can vary dynamically, the current draw on the battery may vary widely while the telephone is being used. Current draw within the range of 1 mA to 100 mA is common.

A VCO generates a frequency in response to an applied voltage signal. Since each frequency, within the range of frequencies, that a VCO may generate is linearly proportional to an applied voltage, the VCO is very sensitive to fluctuations of the voltage supply. A highly stable reference voltage is needed to prevent the VCO frequency from varying in response to fluctuations of the battery voltage.

A bandgap reference is useful in many applications because it provides a substantially invariant voltage when subjected to variations of temperature and power supply voltage. Voltage regulation is typically achieved by generating a bandgap voltage and applying this voltage to a resistive chain. At an electrical tap point between the resistive elements of the chain, the preferred amplitude of the voltage is obtained and this serves as the reference supply. Resistors of the resistive chain are selectively chosen to generate the desired voltage amplitude at the tap point.

FIG. 1 illustrates a block diagram representation of a prior art design for a voltage regulator. This voltage regulator is comprised of a bandgap reference circuit 11, a voltage divider, and a feedback amplifier. The bandgap reference voltage is applied to one input of a differential amplifier 14 and a fractional portion of the regulated voltage is applied to the other input, through a MOSFET 15 and resistor 12. The regulated voltage provided by this design is given by the equation: $V_R=(V_{BG}*(R1+R2))/R1$, where $V_{BG}$ is the bandgap voltage, R1 is the value of the resistance element 12, and R2 is the value of resistance element 13.

FIG. 2 illustrates a prior art circuit configuration for implementing the voltage regulator represented in FIG. 1. Here, the bandgap reference voltage is generated at the collector of transistor 21 and is equal to the combined voltage drop across resistor 31 and the base-emitter voltage, $V_{be}$, of transistor 21. The regulated voltage is generated by the resistive chain of resistors 23 and 24 in conjunction with P-MOS transistor 26 and is used as a power source for the bandgap reference circuitry, as well as an external load. An emitter-coupled pair of transistors, 27 and 28, form a differential feedback amplifier used to modulate the current conducted by the drain-source junction of transistor 26. By modulating the drain-source current of transistor 26 in response to the amplitude difference between the bandgap reference voltage and the portion of the output reference voltage dropped across resistor 24, it is possible to maintain a constant DC voltage potential at the regulated voltage terminal, $V_{reg}$. A constant, regulated voltage potential may be sustained even if the supply voltage drifts or the current changes in response to load variations.

To achieve a highly accurate voltage potential across resistor 24 and at the output of the regulator (i.e., good power supply rejection), the feedback amplifier must have a large gain. With prior art designs, it is difficult to obtain both a large gain and a high degree of stability for the feedback amplifier. Increases in gain are realized through modifications that cause concomitant decreases in stability, and vice versa. The gain of the differential amplifier may be increased by increasing the value of resistor 30. However, the increased magnitude of resistor 30 causes a phase-gain pole, at the gate of transistor 26, to move to a lower frequency. By moving the phase-gain pole to a lower frequency, the voltage regulator's stability is degraded drastically. Use of a current mirror, from the gain stage to the output transistor 26, will not overcome the problem when the voltage regulator is used to provide power to an external device having large load variations.

SUMMARY OF THE INVENTION

The present invention provides a voltage regulator that avoids the need to trade improvements of gain for reductions of stability, or improvements of stability for reductions of gain. An additional gain-boosting stage is provided between a bandgap reference circuit and a differential amplifier of the voltage regulator. The additional gain stage increases the overall gain of the feedback amplifier without lowering the gain-phase pole at the output of the amplifier, thereby providing a high degree of stability.

BRIEF DESCRIPTION OF THE DRAWINGS

The present invention will now be further described in the following paragraphs of the specification and may be better understood when read in conjunction with the attached drawings, in which.

DETAILED DESCRIPTION OF THE INVENTION

The preferred embodiment of the this invention provides a voltage regulator designed to regulate a DC supply voltage accurately and stably, while supplying a high-level output current to an attached load. The regulated voltage should remain stable and invariant even when the supply voltage drifts and the load changes drastically. Operational benefits of a voltage regulator having this design include:

1. a highly stable, regulated voltage;
2. an ability to source a large amount of current to a variable load;
3. good output ripple attenuation; and
4. good power supply rejection.

Figure 1:
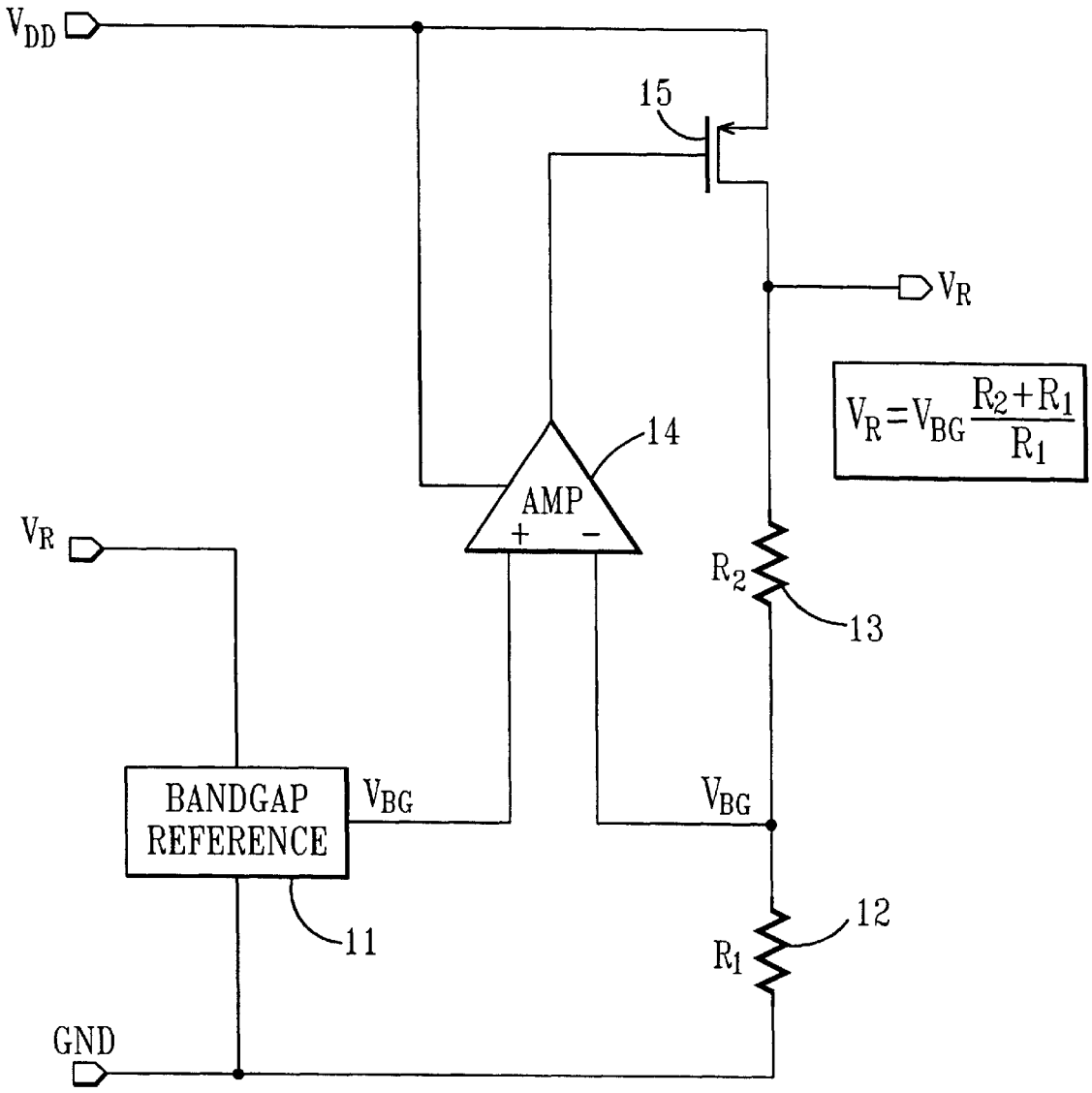
FIG. 1 PRIOR ART
FIG. 1 illustrates a block diagram representation of a prior art voltage regulator.
Figure 2:
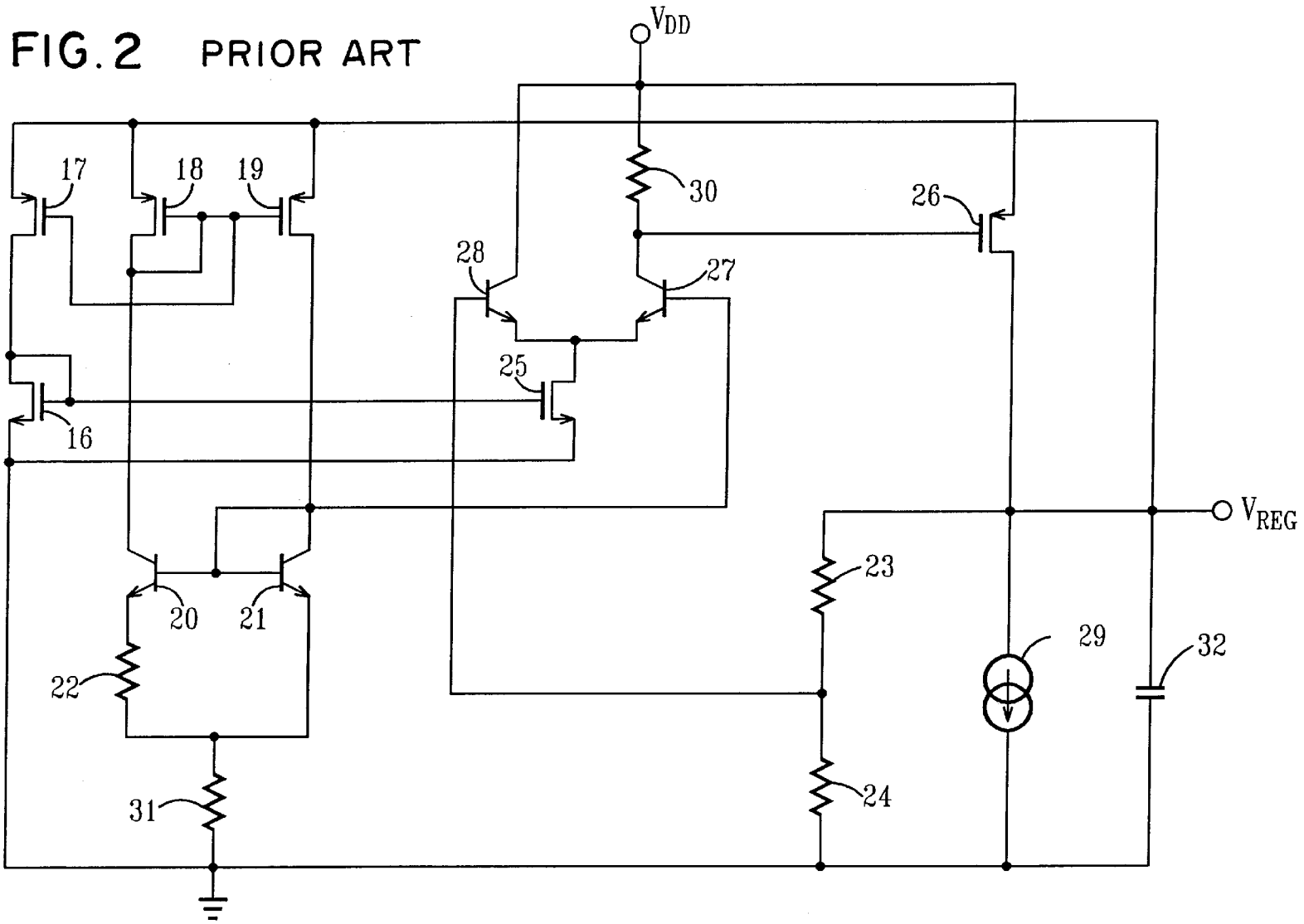
FIG. 2 PRIOR ART
FIG. 2 illustrates a prior art circuit for implementing the voltage regulator represented by FIG. 1.
Figure 3:
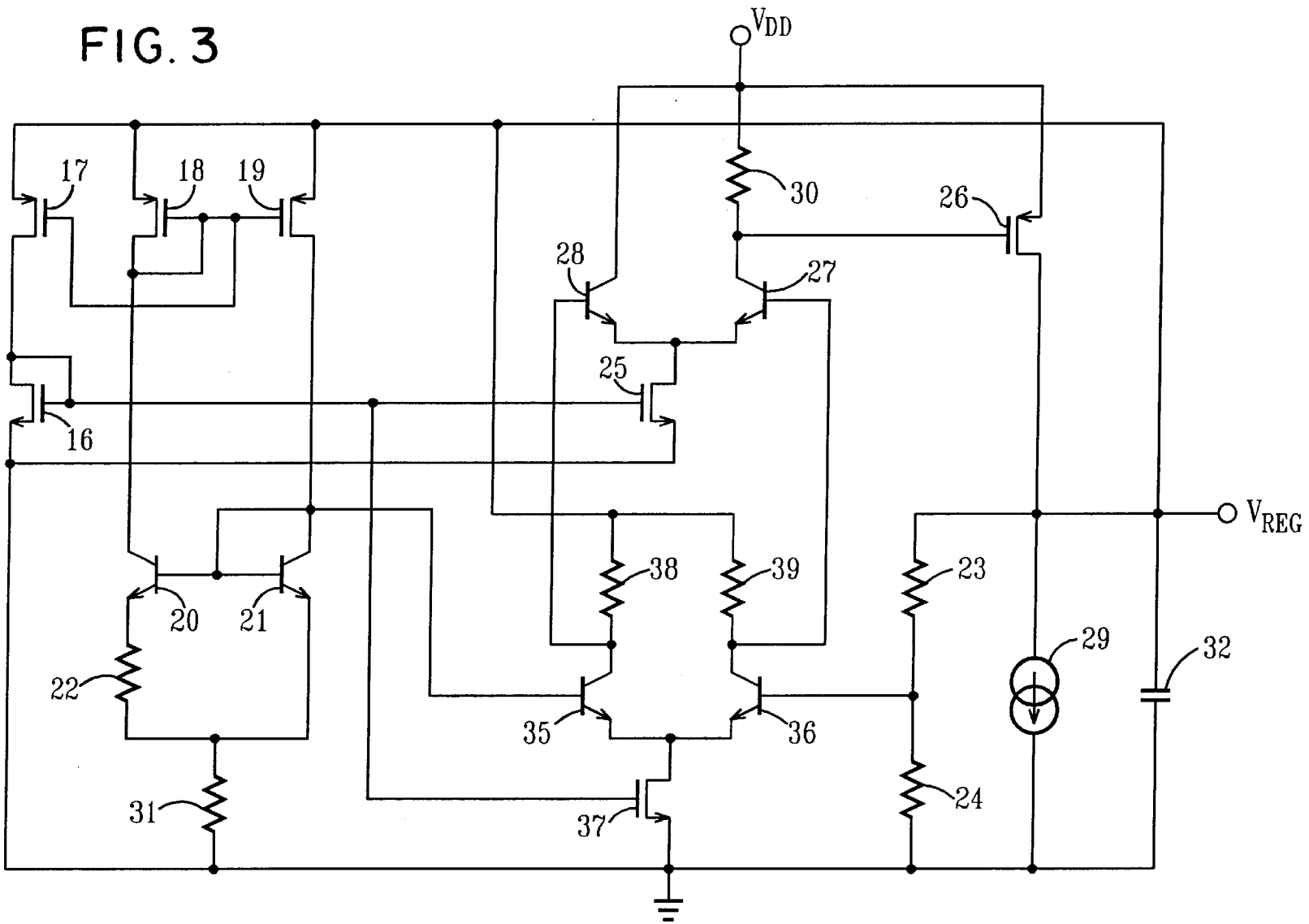
FIG. 3 illustrates the circuit for implementing the preferred embodiment of the invention.

FIG. 3 illustrates the inclusion of a second gain-boosting stage in the voltage regulator design of FIG. 2. The gain-boosting stage is comprised of an emitter-coupled, bipolar transistor pair, 35 and 36, and resistors 38 and 39.

A bandgap reference voltage is generated by transistors 20 and 21, resistors 22 and 31, and the current mirror formed by P-MOS transistors 18 and 19. The current of the bandgap reference, which is proportional to absolute temperature (PTAT), is mirrored to the feedback gain stages through P-MOS transistor 17, and N-MOS transistors 16, 25, and 37. Using the mirrored current from the bandgap reference circuit to modulate the gain of the differential amplifiers 27 and 28, allows the gain of the feedback amplifier to be regulated independently of temperature.

A first feedback loop is formed by connecting the source of transistor 26 to the drains of transistors 17, 18, and 19 and the collector resistors of transistors 35 and 36. This feedback loop supplies the regulated voltage $V_{reg}$, at the source of transistor 26, to the bandgap reference block as a voltage supply. Using a regulated voltage supply to power the bandgap reference block improves the power supply rejection and the accuracy of the bandgap voltage. A second feedback loop, between the output and input of the pair of differential amplifiers, controls the regulated voltage, $V_{reg}$. This second feedback loop is formed by connecting the collector of transistor 27, from the second differential amplifier, to the gate of transistor 26. The gate signal on transistor 26 regulates the current flow through the source of transistor 26 and this current is converted to a voltage potential by serially connected resistors 23 and 24. The voltage potential across resistor 24 is provided to the base of transistor 36 of the first differential amplifier to complete the feedback loop.

Each of the differential amplifiers 36, 36 and 27, 28 has an associated gain given by the product of the value of the pull-up resistor 30, 38, or 39, connected to the collector of one of the emitter-coupled transistors, and the differential amplifier gain, $g_m$. The two differential amplifiers 36, 36 and 27, 28 are electrically configured to generate an amplification gain proportional to the product of their individual amplification gains. As a result, the total gain of the feedback amplifier, formed by the pair of differential amplifiers, is given by the equation:

$$V_{gain,total}=V_{gain,39}*V_{gain,30}=(g_{m,1}*R10)*(g_{m,2}*R0)=g_{m,1}*g_{m,2}*R0*R10,$$

where $g_{m,1}$ and $g_{m,2}$ are the gains of the first and second differential amplifiers, respectively, R0 is the resistance value of resistor 30, and R10 is the resistance value of resistor 39. A resistor load is used at the amplifier output to avoid saturating the amplifier and support a wide range of current drive.

An initial, regulated voltage may be generated by a bandgap reference circuit. The initial voltage is generated at the collector of transistor 21 and is equal to the sum of the voltage potentials across resistor 31 and the base-emitter junction, $V_{be,21}$, of transistor 21. This voltage is applied to the base-emitter junction of transistor 35, which is an input of a differential amplifier formed by the emitter-coupled pair of transistors 35 and 36. The amplitude difference between this signal and the feedback signal applied to the other input of the differential amplifier, (i.e., the base-emitter junction of transistor 36), is amplified by the emitter-coupled pair to generate larger voltage potentials across resistors 38 and 39. Developed across resistor 39 is the amplified voltage potential resulting from the positive difference between $V_{be,36}$, of transistor 36, and $V_{be,35}$, of transistor 35, given by the equation $V_{be,36}-V_{be,35}$. Similarly, the voltage potential developed across 38 is the amplified potential resulting from the positive difference given by the equation $V_{be,35}-V_{be,36}$. The voltage potentials developed across resistors 38 and 39 are given by the equations: $V_{gain,39}=g_{m,1}*R10$ and $V_{gain,38}=g_{m,1}*R11$, respectively, where $g_{m,1}$ is the gain of the differential amplifier, R10 is the resistance value of resistor 39, and R11 is the resistance value of resistor 38.

Voltage potentials $V_{gain,39}$ and $V_{gain,38}$ are each applied to a different input terminal of a second differential amplifier, formed by the bipolar, emitter-coupled pair of transistors 27 and 28. This second differential amplifier operates in the same manner described for the first differential amplifier. Of interest to this embodiment of the invention, is the amplified voltage potential developed across resistor 30. This potential is given by $V_{gain,30}=g_{m,2}*R0$, where $g_{m,2}$ is the gain of the second differential amplifier, and R0 is value of resistor 30.

Voltage potential $V_{gain,30}$ is applied to the gate of transistor 26 to place the transistor in an active mode of linear operation. Transistor 26 amplifies the voltage potential across its gate-source junction and develops the amplified voltage potential, $V_{DS,26}$, across its drain-source junction using a current generated by the current source 29 and the drain-source junction resistance of transistor 26. The amplitude of the regulated voltage, $V_{reg}$, applied to the output terminal, is given the equation $V_{reg}=V_{DD}-V_{DS,26}$, where $V_{DD}$ is the power supply voltage and $V_{DS,26}$, is the drain source voltage across transistor 26. Current source 29 is a current regulating device, of a type known in the art, for conveying current from the source of transistor 26 to ground potential.

Two feedback signals are derived from the regulated output $V_{reg}$. First, $V_{reg}$ serves as the power supply for the bandgap reference circuit. Second, a fractional portion of the voltage amplitude of $V_{reg}$ is applied to the base-emitter junction of transistor 36. The regulated output voltage is applied to a resistive chain, formed by the series-connected resistors 23 and 24, to obtain the specific voltage amplitude needed to create a stable feedback circuit. This specific voltage amplitude is proportional to the voltage potential across resistor 24.

The above-described invention provides a voltage regulation circuit having a high DC accuracy, a good power supply rejection characteristic, good stability, and a large current sourcing capability for use with devices employing a variable load and voltage supply.

The foregoing description illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the inventive concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A voltage regulator having a high power supply rejection characteristic, comprising:

a voltage regulator circuit providing a first regulated voltage;

a gain stage comprised of two cascaded amplifier stages, having a gain which is proportional to the gain of each of said amplifier stages; a first stage of said amplifier having a first input connected to receive said first regulated voltage; and a voltage modulation device connected to an output of said second stage of said amplifier and to an output terminal for providing a second regulated voltage; said output terminal being connected to a second input of said first amplifier stage, whereby a feedback voltage is created to maintain on said output terminal said second regulated voltage fixed with respect to said first regulated voltage.

2. The voltage regulator according to claim 1, wherein:

said output terminal provides an operating voltage for said voltage regulator circuit.

3. The voltage regulator according to claim 2, wherein:

said voltage regulator circuit is a bandgap reference circuit.

4. The voltage regulator according to claim 2, wherein:

the output signal of said gain stage varies linearly in accordance with the voltage difference between said first regulated voltage and a specific fraction of said second regulated voltage.

5. The voltage regulator according to claim 1, wherein:

said gain stage is comprised of two emitter-coupled, differential amplifiers configured to generate an amplification gain proportional to the product of the individual amplification gains of each emitter-coupled, differential amplifier.

6. The voltage regulator according to claim 5, wherein:

each of said differential amplifiers are comprised of bipolar transistors that have emitters connected through a second transistor, which is controlled by said voltage regulator circuit.

7. The voltage regulator circuit according to claim 6, wherein:

said second transistors form a current mirror circuit with a current source in said voltage regulator circuit.

8. A voltage regulator circuit comprising;

a band gap reference circuit for supplying a reference current which varies as temperature, and a reference voltage which is substantially constant with respect to temperature;

a first differential amplifier stage comprising first and second transistors emitter coupled to a transistor which provides a mirror current to said first and second transistors proportional to said band gap circuit reference current;

a second differential amplifier stage comprising first and second transistors emitter coupled to a transistor which provides a mirror current proportional to said reference current to said second differential amplifier stage first and second transistors, a base of said second transistor being connected to receive said reference voltage, said second differential amplifier stage having first and second output connections connected to first and second input connections of said first differential amplifier stage and;

an output transistor connected to a collector of said first differential amplifier stage first transistor and to a load impedance terminal; said first transistor of said second differential amplifier receiving a feedback voltage on its base from said load impedance whereby a regulated voltage is produced across said load impedance.

9. The voltage regulator according to claim 8 wherein said band gap reference circuit receives an operating voltage from said output transistor.

10. The voltage regulator according to claim 8 wherein said load impedance terminal is terminated with a current source and regulation capacitor.

* * * * *